US010333263B2

(12) United States Patent
Wu et al.

(10) Patent No.: US 10,333,263 B2
(45) Date of Patent: Jun. 25, 2019

(54) CABLE CONNECTOR ASSEMBLY HAVING CABLE OF A FLAT STRUCTURE

(71) Applicant: FOXCONN INTERCONNECT TECHNOLOGY LIMITED, Grand Cayman (KY)

(72) Inventors: Jerry Wu, New Taipei, CA (US); Jun Chen, Kunshan (CN); Fan-Bo Meng, Kunshan (CN)

(73) Assignee: FOXXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/034,771

(22) Filed: Jul. 13, 2018

(65) Prior Publication Data

US 2019/0020157 A1 Jan. 17, 2019

(30) Foreign Application Priority Data

Jul. 13, 2017 (CN) ..... 2017 1 0568686

(51) Int. Cl.

| | |
|---|---|
| ***H01R 24/64*** | (2011.01) |
| ***H01R 9/05*** | (2006.01) |
| ***H01R 13/6592*** | (2011.01) |
| ***H01B 9/00*** | (2006.01) |
| ***H01B 11/18*** | (2006.01) |
| ***H01P 3/06*** | (2006.01) |
| ***H01R 13/502*** | (2006.01) |
| *H01R 107/00* | (2006.01) |

(52) U.S. Cl.

CPC ..... *H01R 24/64* (2013.01); *H01B 9/003* (2013.01); *H01B 11/1813* (2013.01); *H01P 3/06* (2013.01); *H01R 9/0515* (2013.01); *H01R 13/502* (2013.01); *H01R 13/6592* (2013.01); *H01R 2107/00* (2013.01)

(58) Field of Classification Search

CPC ..... H01R 24/60; H01B 9/003; H01B 11/1813
See application file for complete search history.

(56) References Cited

U.S. PATENT DOCUMENTS

| | | | | |
|---|---|---|---|---|
| 6,630,624 | B2 * | 10/2003 | Tsao | H01B 7/0861 174/113 R |
| 9,350,126 | B2 * | 5/2016 | Little | H01R 24/60 |
| 9,490,549 | B2 * | 11/2016 | Little | H01R 4/023 |
| 9,520,673 | B2 * | 12/2016 | Xing | H01R 13/5845 |
| 9,525,223 | B2 * | 12/2016 | Little | H01R 13/6658 |
| 9,525,227 | B2 * | 12/2016 | Little | H01R 13/6273 |

(Continued)

FOREIGN PATENT DOCUMENTS

| | | |
|---|---|---|
| CN | 204884664 | 12/2015 |
| CN | 105702334 | 6/2016 |

(Continued)

*Primary Examiner* — Ross N Gushi

(74) *Attorney, Agent, or Firm* — Wei Te Chang; Ming Chieh Chang

(57) ABSTRACT

A cable connector assembly includes a connector and a cable, the cable including plural core wires arranged in an upper and a lower rows, wherein several pairs of high-speed signal lines, a pair of low-speed signal lines, a power signal line, and a spare signal line are located in the upper row, and other pairs of high-speed signal lines, a detection signal line, a power supply line, another spare signal line, and another power signal line are located in the lower row.

20 Claims, 8 Drawing Sheets

(56) References Cited

U.S. PATENT DOCUMENTS 9,583,889 B2 * 2/2017 Wu ..... H01R 13/6593
9,590,363 B2 * 3/2017 Wu ..... H01R 13/6585
9,607,738 B1 * 3/2017 Wu ..... H01B 11/20
9,620,910 B2 * 4/2017 Chen ..... H01R 13/6581
9,697,926 B2 * 7/2017 Huang ..... H01B 7/0823
9,698,540 B2 * 7/2017 Xing ..... H01R 13/6593
9,698,544 B2 * 7/2017 Wu ..... H01R 13/7175
9,762,009 B2 * 9/2017 Little ..... H01R 24/60
9,768,568 B1 * 9/2017 Jin ..... H01R 24/60
9,774,111 B2 * 9/2017 Liang ..... H01R 12/57
9,780,495 B2 * 10/2017 Wu ..... H01R 4/023
9,825,407 B2 * 11/2017 Wu ..... H01R 13/6581
9,843,143 B2 * 12/2017 Wu ..... H01R 13/665
9,881,717 B2 * 1/2018 Chen ..... H01R 13/6581
9,979,145 B2 * 5/2018 Wu ..... H01R 24/60
10,014,638 B1 * 7/2018 McCracken ..... H01R 24/60
10,063,018 B2 * 8/2018 Xing ..... H01R 13/516
10,084,245 B2 * 9/2018 Chang ..... H01R 13/6586
10,096,936 B2 * 10/2018 Ju ..... H01R 13/6275
10,103,505 B1 * 10/2018 Izaki ..... H01R 31/06
10,134,507 B2 * 11/2018 Wu ..... H01B 11/08
10,135,105 B2 * 11/2018 Ishikawa ..... H01B 1/02
2010/0084157 A1 * 4/2010 Wang ..... H01B 11/12 174/107
2011/0278043 A1 * 11/2011 Ueda ..... H01B 7/1895 174/115
2014/0305675 A1 * 10/2014 Liang ..... H01B 11/00 174/107
2015/0044886 A1 * 2/2015 Little ..... H01R 12/75 439/55
2015/0288107 A1 * 10/2015 Wu ..... H01R 13/6593 439/357
2016/0020002 A1 * 1/2016 Feng ..... H01B 11/20 174/103
2016/0079689 A1 * 3/2016 Wu ..... B23K 1/0016 439/581
2016/0141817 A1 * 5/2016 Wu ..... H01R 24/60 439/676
2016/0225488 A1 * 8/2016 Pon ..... H01B 9/003
2017/0025203 A1 * 1/2017 Chen ..... H01B 11/20
2017/0093076 A1 * 3/2017 Yokoyama ..... H01R 4/02
2017/0110223 A1 * 4/2017 Wu ..... H01B 11/20
2017/0140851 A1 * 5/2017 Chen ..... H01R 13/6581
2017/0149153 A1 * 5/2017 Gou ..... H01R 12/53
2017/0149183 A1 * 5/2017 Gou ..... H01R 12/716
2017/0256837 A1 * 9/2017 Ishikawa ..... H01B 1/02
2017/0330651 A1 * 11/2017 Kunz ..... H01B 11/1821
2018/0001407 A1 * 1/2018 Wu ..... B23K 1/0016
2018/0040969 A1 * 2/2018 Wu ..... H01R 13/6593
2018/0115122 A1 * 4/2018 Xing ..... H01R 13/516
2018/0166797 A1 * 6/2018 Ju ..... H01R 13/6597
2018/0166825 A1 * 6/2018 Ju ..... H01R 13/6275
2018/0212337 A1 * 7/2018 Chang ..... H01R 13/6586
2018/0375232 A1 * 12/2018 Wu ..... H01R 4/182
2019/0020157 A1 * 1/2019 Wu ..... H01R 24/64

FOREIGN PATENT DOCUMENTS

CN 205583296 9/2016
CN 106450827 2/2017

* cited by examiner

CABLE CONNECTOR ASSEMBLY HAVING CABLE OF A FLAT STRUCTURE

BACKGROUND OF THE INVENTION

1. Field of the Invention

The present invention relates to a cable connector assembly having a cable of a flat structure.

2. Description of Related Arts

U.S. Patent Application Publication No. 2016/0079689, published on Mar. 17, 2016, shows a cable connector assembly including a connector and a cable electrically connected to the connector. The cable includes a plurality of core wires and associated outer insulative layers. The cross-section of the cable is circular such that the cable has a large dimension in the thickness direction.

An improved cable connector assembly is desired.

SUMMARY OF THE INVENTION

An object of the present invention is to provide an improved cable connector assembly with a cable having a small dimension in the thickness direction.

To achieve the above-mentioned object, a cable connector assembly comprises: a connector; and a cable electrically connected to the connector and extending along a longitudinal direction, the cable including a plurality of core wires, the core wires comprising plural pairs of high-speed signal lines for transmitting high-speed signals, a pair of low-speed signal lines for transmitting low-speed signals, a pair of power signal lines for transmitting power signals, a pair of spare signal lines, a detection signal line for transmitting detection signals, and a power supply line, wherein the core wires are arranged in an upper row and a lower row along a width direction perpendicular to the longitudinal direction, and a part of the high-speed signal lines, the pair of low-speed signal lines, one power signal line, and one spare signal line are located in the upper row, and the remaining high-speed signal lines, the detection signal line, the power supply line, another spare signal line, and another power signal line are located in the lower row.

DETAILED DESCRIPTION OF THE PREFERRED EMBODIMENT

Figure 1:
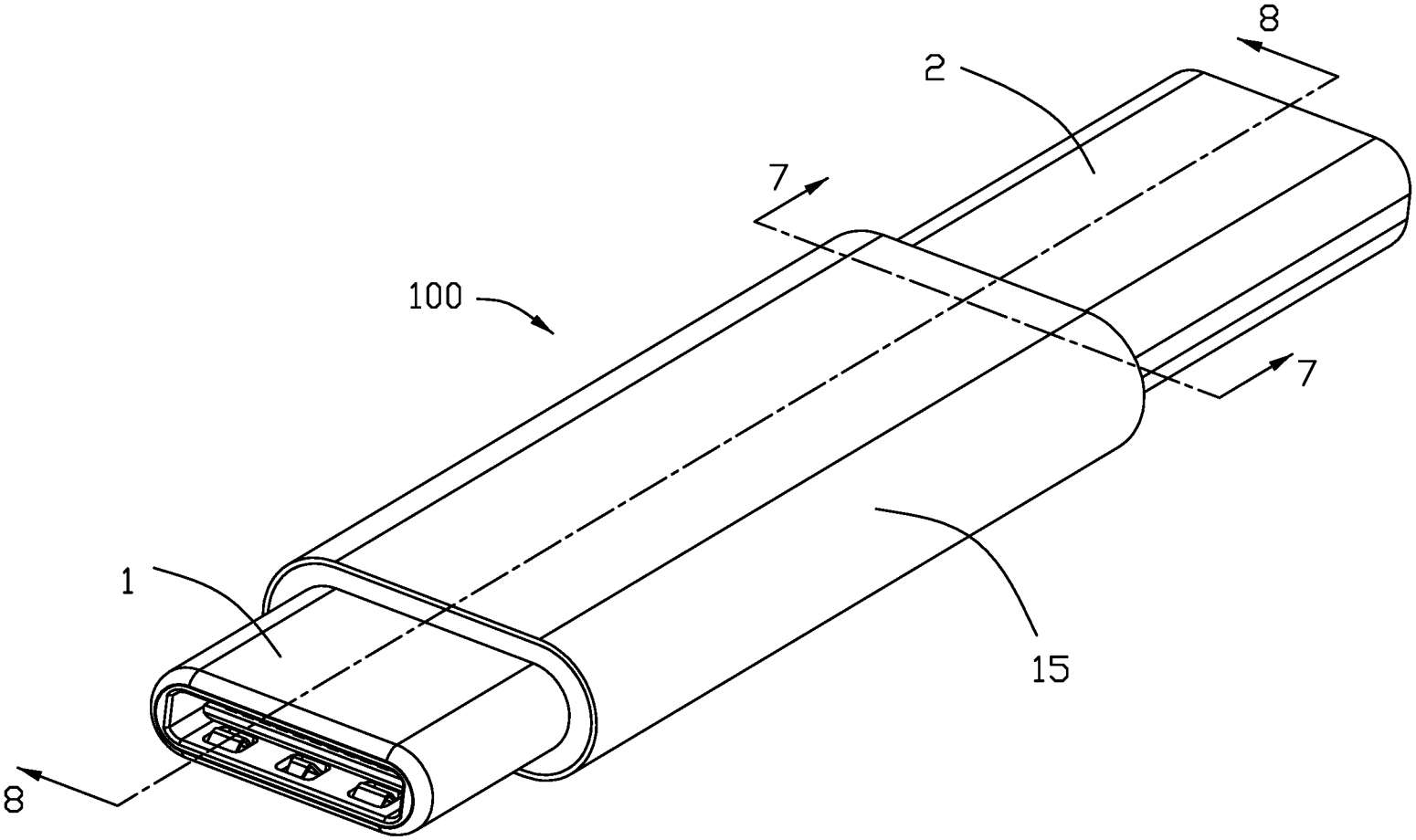
FIG. 1 is a perspective view of a cable connector assembly in accordance with the present invention.
Figure 2:
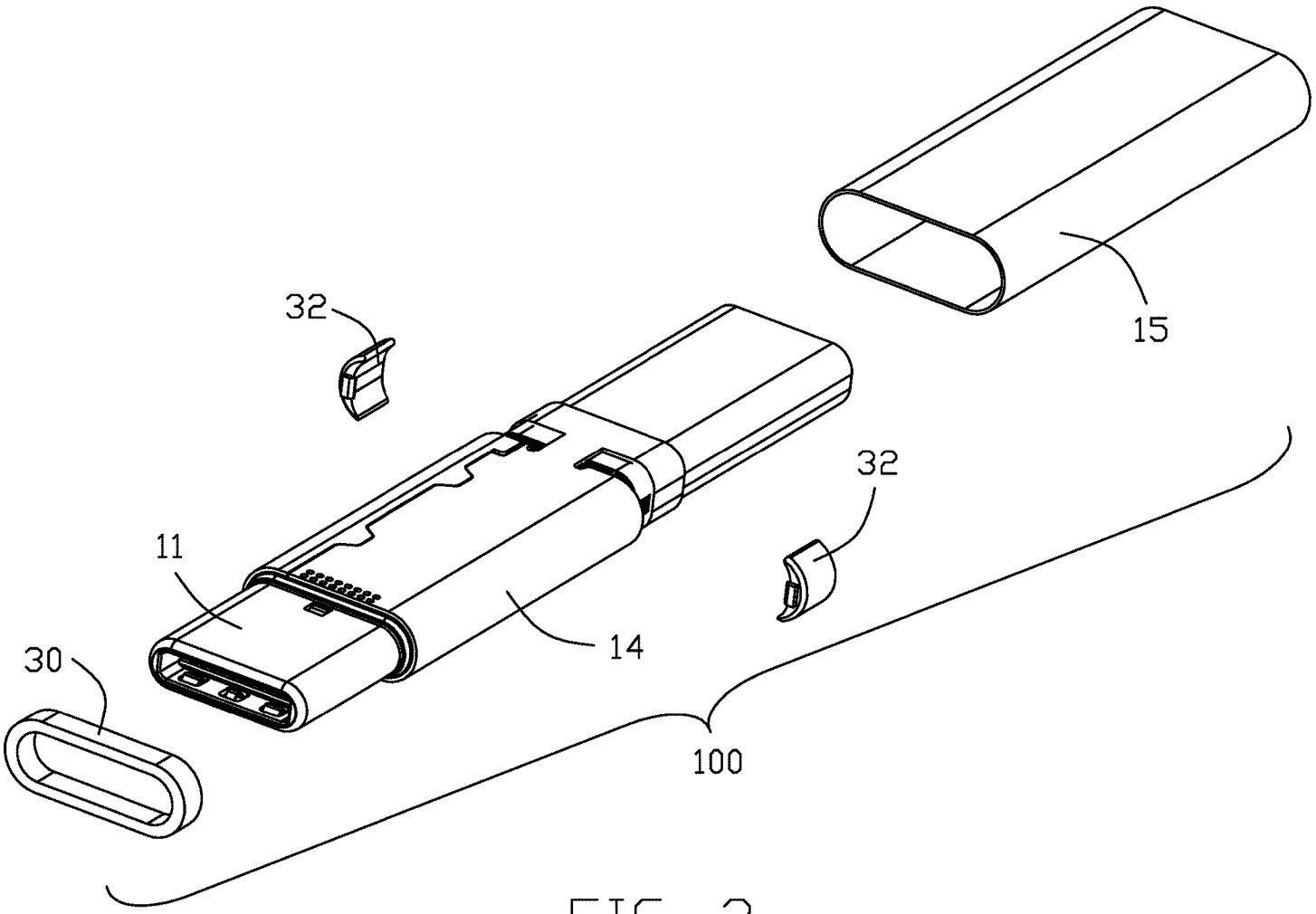
FIG. 2 is a partially exploded view of the cable connector assembly shown in FIG. 1.
Figure 3:
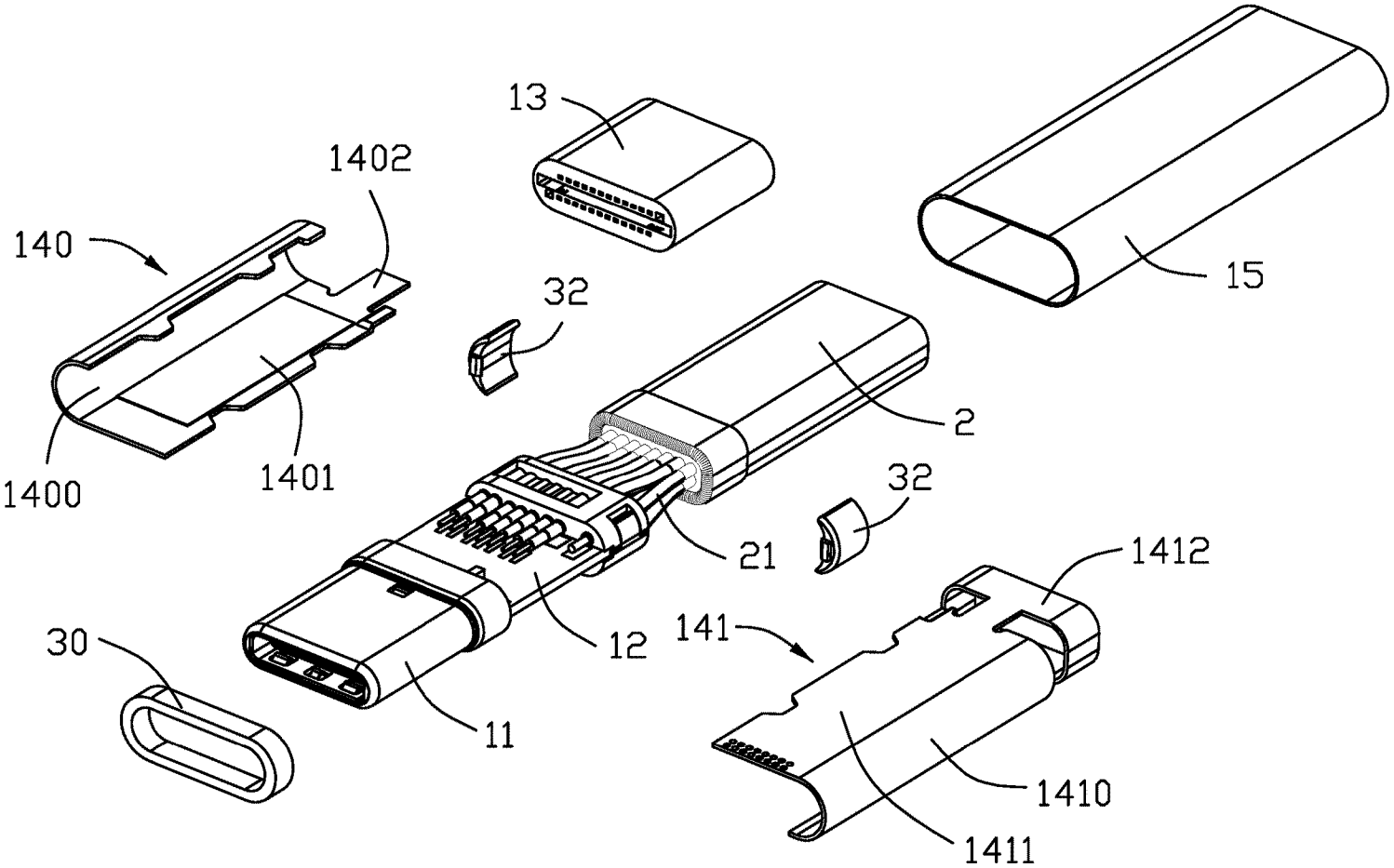
FIG. 3 is a further partially exploded view of the cable connector assembly shown in FIG. 2.
Figure 4:
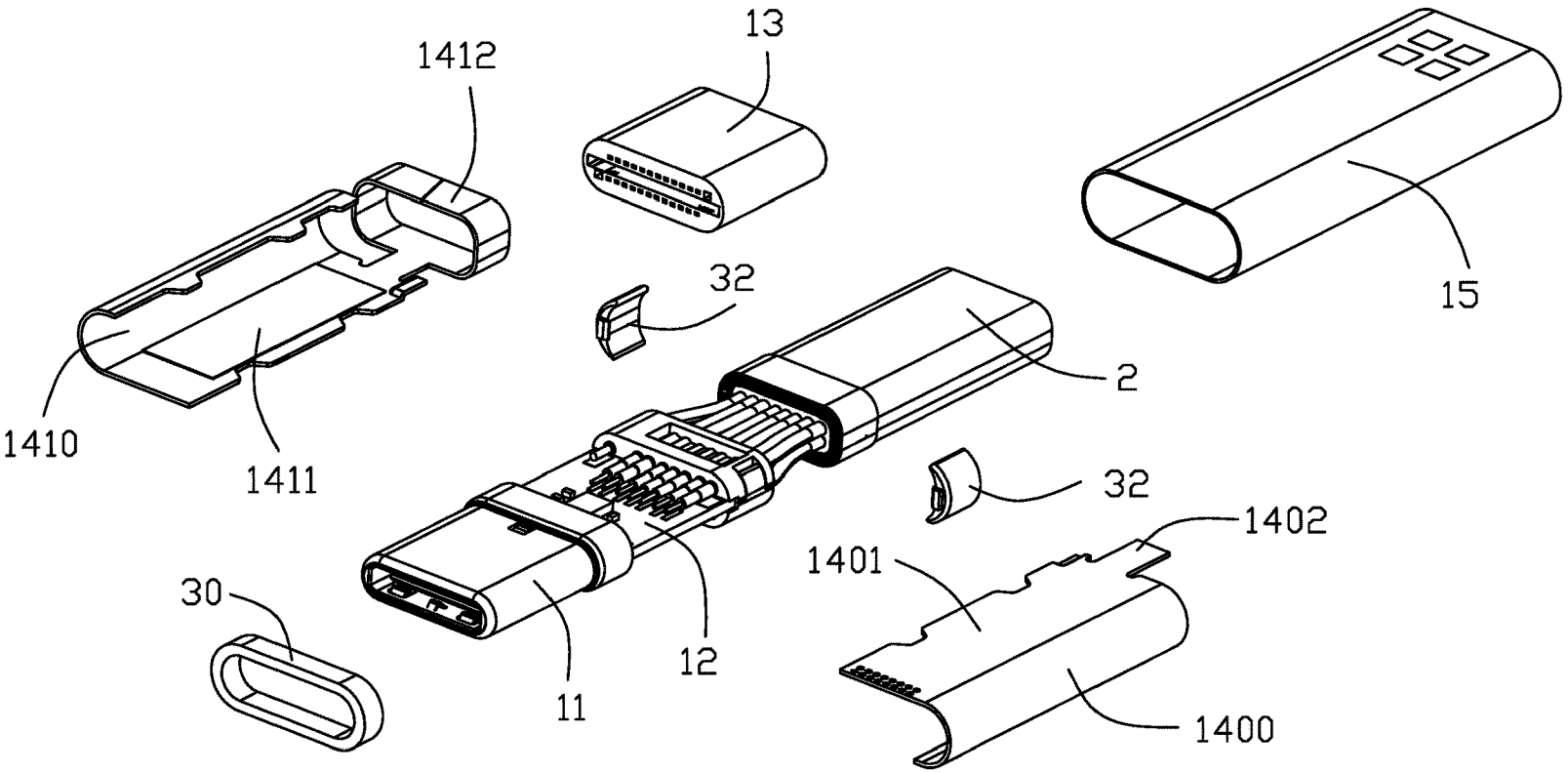
FIG. 4 is an exploded view similar to FIG. 3, but from a different perspective.
Figure 5:
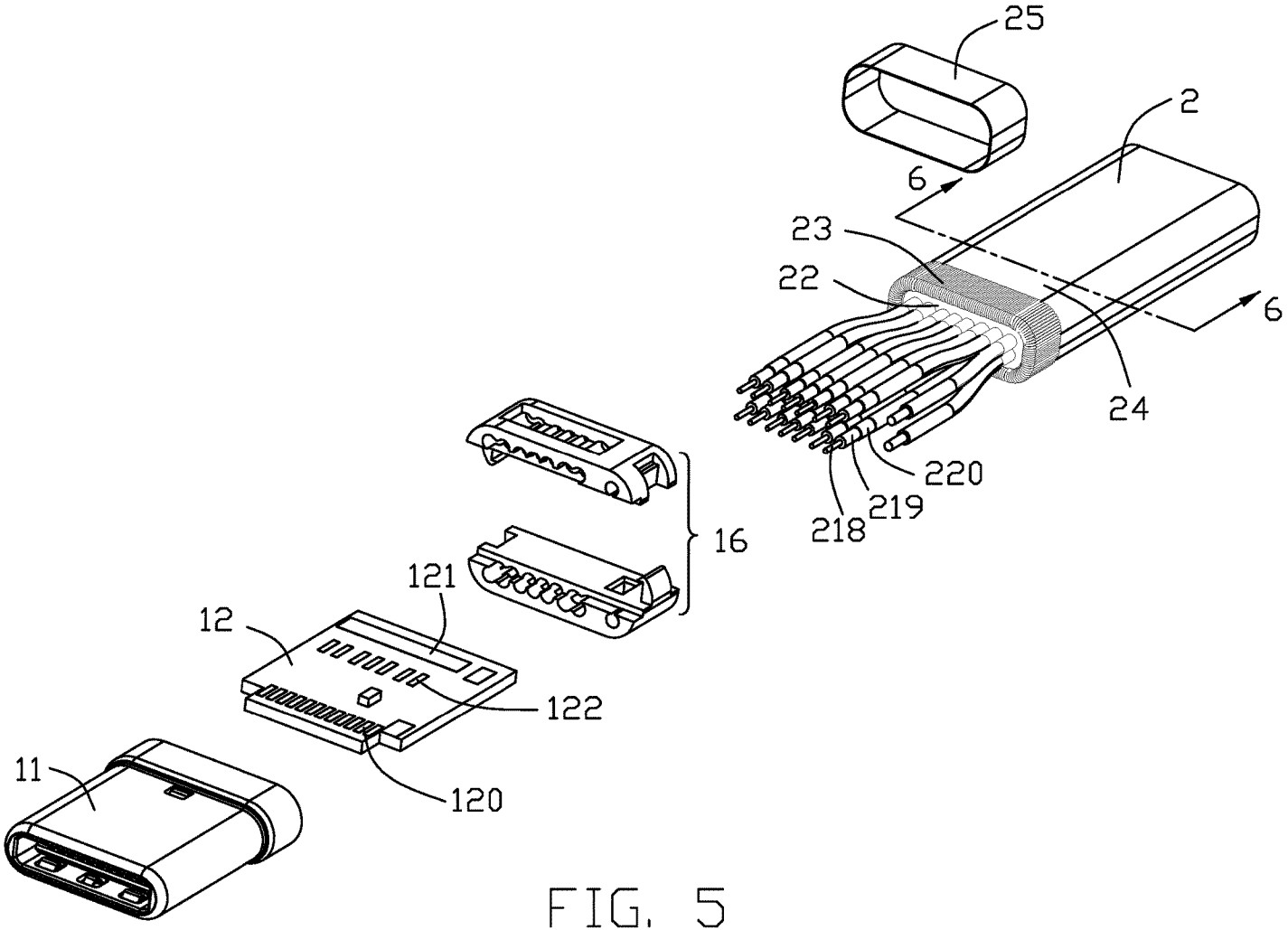
FIG. 5 is an exploded view of the cable connector assembly shown in FIG. 3.
Figure 6:
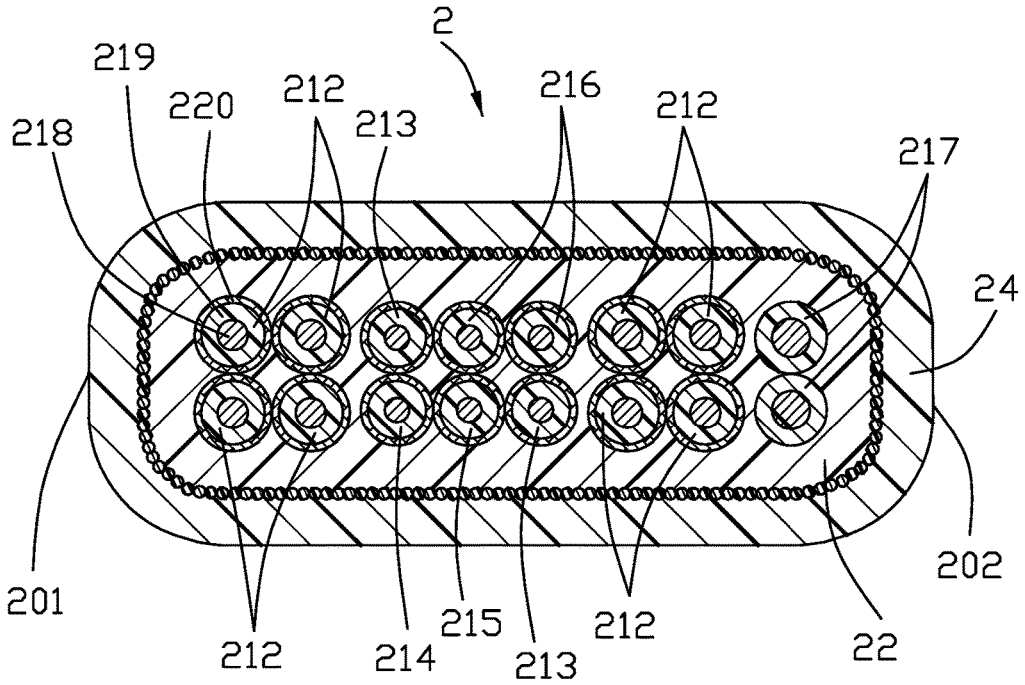
FIG. 6 is an cross-section view of the cable of the cable connector assembly shown in FIG. 1.
Figure 7:
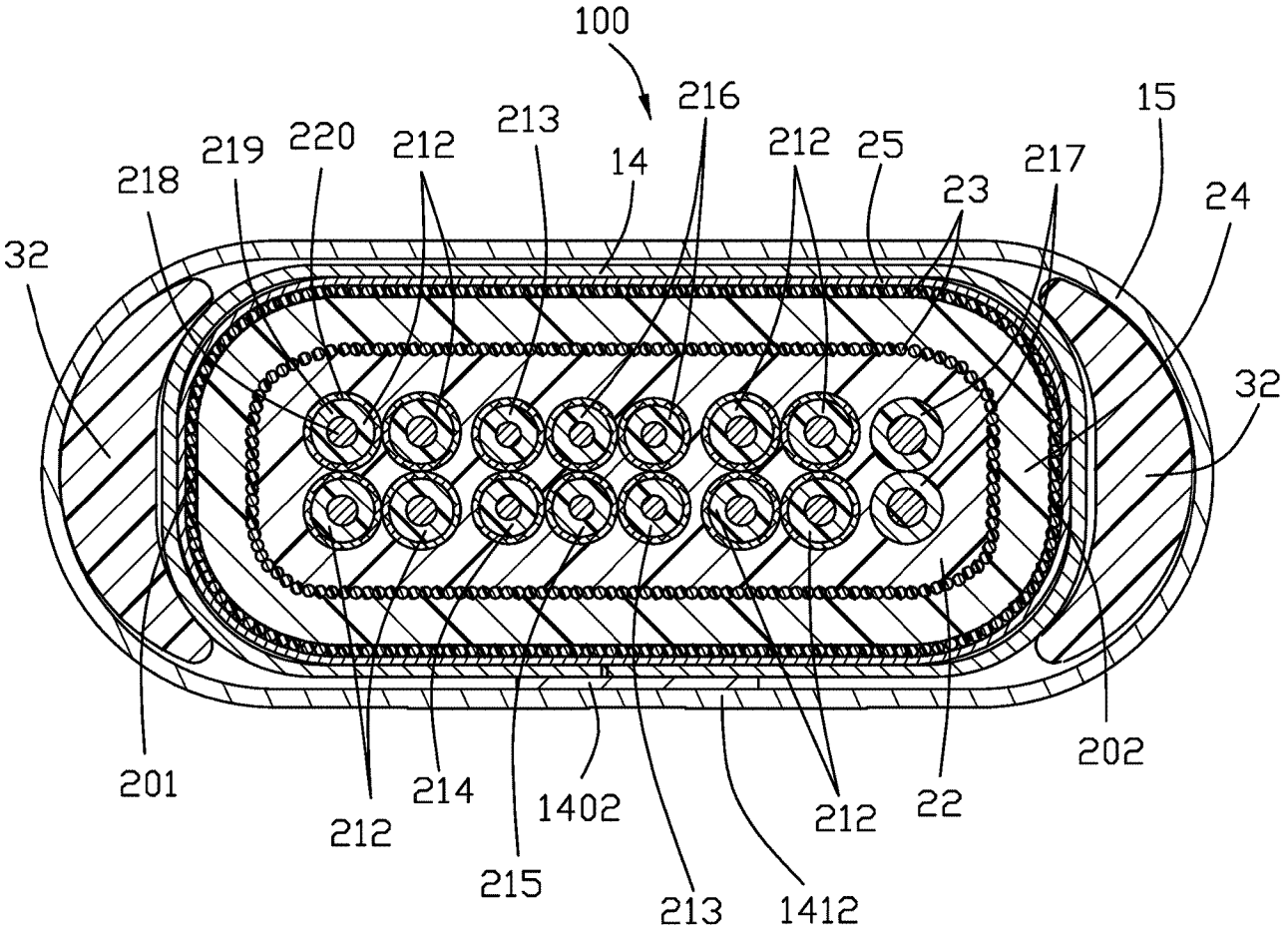
FIG. 7 is another cross-section view of the cable of the cable connector assembly shown in FIG. 1.
Figure 8:
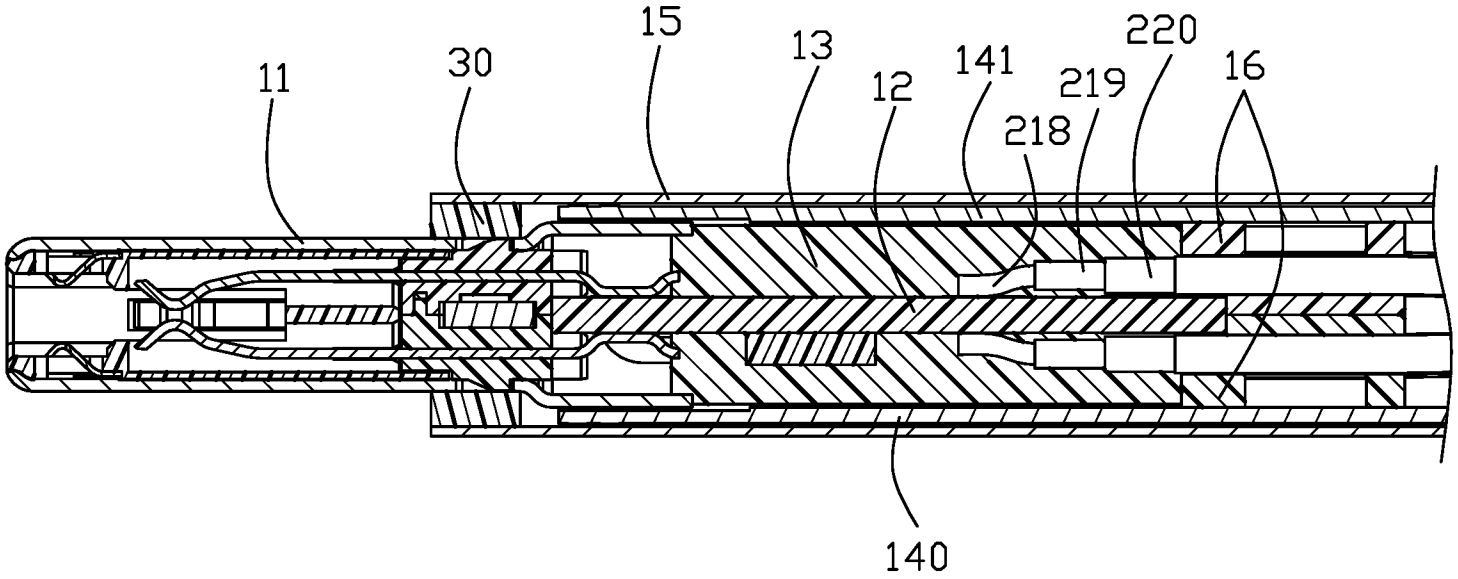
FIG. 8 is another cross-section view of the cable of the cable connector assembly of FIG. 1.

Referring to FIGS. 1 to 8, a cable connector assembly in accordance with the present invention for mating with a mating connector (not shown), comprises an electrical connector 1 and a cable 2 electrically connected with the electrical connector 1. The electrical connector 1 includes s mating member 11 for mating with the mating connector, a printed circuit board (PCB) 12 connected between the mating member 11 and the cable 2, an inner mold 13 enclosing the conjunction portion of the cable 2 and the PCB 12, a shielding case 14 enclosing the mating member 11 and the PCB 12, an insulative outer case 15 enclosing the shielding case 14 and the cable 2, and a management block 16 for locating the cable 2.

Referring to FIGS. 3 to 6, The cable 2 includes a plurality of core wires 21, an inner insulative layer 22 enclosing the corresponding core wires 21, a first braided layer 23 enclosing the inner insulative layer 22 and a outer insulative layer 24 formed on outside of the first braided layer 23. The cable 2 is used to transmit USB Type C signal. The core wires 21 includes four (differential) pairs of high-speed signal lines 212 for transmitting high-speed signals, a pair of spare signal lines 213, a detection signal line 214 for transmitting detection signals, a power supply line 215 for supplying power to the connector, a pair of low-speed signal lines 216 and a pair of power signal lines 217 that transmit power signals. The low-speed signal lines 216 are used to transmit USB 2.0 signals with lower speed. The pair of power signal lines 217 is used respectively to transmit positive and negative signals of the power source. The pair of spare signal lines 213 can set transmission of signals such as audio as required.

All the core wires 21 except the pair of power signal wires 217 are coaxial wires. The coaxial lines include a center conductor 218, an insulating layer 219 covering the center conductor 218 and a second braided layer 220 wrapped around the insulating layer 219. The first and second braided layers 23, 220 can effectively weaken the external radiation of the center conductor 218 and strengthen its own anti-interference ability.

The core wires 21 are arranged up and down in two rows. An upper row includes two pairs of high-speed signal lines 212, the pair of low-speed signal lines 216, a spare signal line 213 and a power signal line 217. The lower row includes two pairs of high-speed signal lines 212, a detection signal line 214, a power supply line 215, a spare signal line 213 and a power signal line 217. The cable 2 is flat and is divided into a first side 201 and a second side 202 in a width direction. The two pairs of high-speed signal lines 212 are located on the first side 201 and are oppositely disposed one above the other. The power signal lines 217 are located on the second side 202 and are oppositely disposed one above the other. The other two pairs of high-speed signal lines 212 are located inside the power signal lines 217 in the width direction. The pair of low-speed signal lines 216 and a spare signal line 213 are disposed between the two pairs of high-speed signal lines 212 in the upper row, and the spare signal lines 213 are located between the low-speed signal lines 216 and the high-speed signal lines 212 located on the first side 201. The detection signal line 214 in the lower row is adjacent to the high speed signal lines 212 on the first side 201. The lower spare signal line 213 in the low row is adjacent to the high speed signal lines 212 near the second side 202. The power supply line 215 for powering the connector 1 internally is located between the detection signal line 214 and the spare signal line 213 in the lower row. This arrangement allows the spare signal lines 213 to be arranged separately, effectively preventing them from coupling with each other.

The cable 2 is not provided with a ground wire, instead, the second braided layer 220 of each coaxial line serves as a ground wire, and can satisfy a voltage drop of 250 mV when there is a current of 3 A or 5 A. The specifications of the two power signal lines 217 can be flexibly designed with 26 or 24 AWG (American wire gauge), and can meet 500 mV voltage drop when there is 3 A or 5 A current.

The PCB 12 includes an upper surface and a lower surface, and the front and back conductive sheets are symmetrical, because it can be inserted along both of the forward and backward direction. The PCB 12 defines a plurality of first conductive pads 120 on a front end thereof, a grounding region 121 on a rear end and a plurality of second conductive pads 122 between the first conductive pads 120 and the grounding region 121. Both of the upper surface and the lower surface define the first conductive pads 120, the grounding region 121 and the second conductive pads 122. The first conductive pads 120 are electrically connected to the contacts of the mating member 11. The grounding regions 121 are soldered to the second braided layers 220. Each of the center conductors 218 is electrically connected to the second conductive pads 122 corresponding on the front and rear ends of the PCB 12 respectively.

The shielding case 14 includes a first case 140 and a second case 141. The first case 140 includes a first edge 1400, an upper surface 1401, and a tail portion 1402 extending from the upper surface 1401 toward the extending direction of the cable 2. The second case 141 includes a second edge 1410, a lower surface 1411 and a retaining portion 1412 extending from the lower surface 1411 towards the extending direction of the cable 2. The end of the first braided layer 23 of the cable 2 is overturned on the surface of the cable 2, and is wrapped with a copper foil 25. The tail portion 1402 extends to the copper foil 25. The retaining portion 1412 is held on the tail portion 1402 and the copper foil 25 to be caulked on the cable 2. The first case 140 and the second case 141 are assembled together by laser welding. The shielding case 14 and the mating member 11 are also assembled by laser welding. In this embodiment, an insulative or rubbery front cap 30 surrounds the mating member 11 and is enclosed in the shielding case 14 for better sealing performance, and a pair of insulative or rubbery rear caps 32 sandwiched between the copper foil 25 and the outer case 15 for compensating the contour difference between the outer profile of the cable 2 with the associated copper foil 25 thereon and that of the outer case 15 which is essentially of a capsular cross-sectional configuration.

What is claimed is:

1. A cable connector assembly comprising:

a connector; and a cable electrically connected to the connector and extending along a longitudinal direction, the cable including a plurality of core wires, the core wires comprising plural pairs of high-speed signal lines for transmitting high-speed signals, a pair of low-speed signal lines for transmitting low-speed signals, a pair of power signal lines for transmitting power signals, a pair of spare signal lines, a detection signal line for transmitting detection signals, and a power supply line; wherein the core wires are arranged in an upper row and a lower row along a width direction perpendicular to the longitudinal direction, and a part of the high-speed signal lines, the pair of low-speed signal lines, one power signal line, and one spare signal line are located in the upper row, and the remaining high-speed signal lines, the detection signal line, the power supply line, another spare signal line, and another power signal line are located in the lower row.

2. The cable connector assembly as claimed in claim 1, wherein the high-speed signal lines located in the upper and lower rows are oppositely disposed along a thickness direction perpendicular to the longitudinal direction and the width direction, and the high-speed signal lines in same row are disposed at intervals.

3. The cable connector assembly as claimed in claim 1, wherein the cable is provided with a first side and an opposite second side along the width direction, and the part of the high-speed signal lines is located on the first side, the power signal lines are located on the second side, and the remaining high speed signal lines are located inside the power signal lines along the width direction.

4. The cable connector assembly as claimed in claim 3, wherein the low-speed signal lines are located between the spare signal line and the high-speed signal lines near the second side.

5. The cable connector assembly as claimed in claim 3, wherein the detection signal line is adjacent to the high-speed signal line on the first side, and the spare signal line in the lower row is adjacent to the high-speed signal line near the second side, and the power supply line is located between the detection signal line and the spare signal line in the lower row.

6. The cable connector assembly as claimed in claim 1, wherein the core wires other than the power signal lines are all coaxial wires, and the coaxial wires include a braided layer.

7. The cable connector assembly as claimed in claim 6, wherein the connector includes a printed circuit board electrically connected with the cable, the printed circuit board includes an upper surface and a lower surface, the printed circuit board defines grounding region on both of the upper surface and the lower surface, and the braided layers of the upper and lower rows are respectively electrically connected to the corresponding grounding regions.

8. The cable connector assembly as claimed in claim 1, wherein the connector includes a shielding case riveted to the cable, and the shielding case includes:

a first case including a first side and an upper surface;

a second case including a second side and a lower surface; and the first case and the second case are welded together.

9. The cable connector assembly as claimed in claim 8, wherein the connector includes a mating member, and the shielding case is welded to the mating member.

10. A cable comprising:

a plurality of core wires, the core wires comprising plural pairs of high-speed signal lines for transmitting high-speed signals, a pair of low-speed signal lines for transmitting low-speed signals, a pair of power signal lines for transmitting power signals, a pair of spare signal lines, a detection signal line for transmitting detection signals, and a power supply line; wherein the core wires are arranged in an upper row and a lower row along a width direction perpendicular to the longitudinal direction, and a part of the high-speed signal lines, the pair of low-speed signal lines, one power signal line, and one spare signal line are located in the upper row, and the remaining high-speed signal lines, the detection signal line, the power supply line, another spare signal line, and another power signal line are located in the lower row.

11. The cable as claimed in claim 10, wherein the spare signal lines are respectively placed in the upper and lower rows, and the positions of the spare signal lines in the width direction are staggered with each other.

12. The cable as claimed in claim 10, wherein the high-speed signal lines located in the upper and lower rows are oppositely disposed along a thickness direction perpendicular to the longitudinal direction and the width direction, and the high-speed signal lines in same row are disposed at intervals.

13. The cable as claimed in claim 10, wherein the core wires other than the power signal lines are all coaxial wires, and the coaxial wires include a first braided layer.

14. The cable as claimed in claim 13, wherein the cable further includes an inner insulative layer enclosing the core wires and a second braided layer covering the inner insulative layer.

15. The cable as claimed in claim 10, wherein the pair of power signal lines are oppositely disposed on an outermost side of the core wires.

16. A cable connector assembly comprising:

a printed circuit board;

a mating member connected to a front edge region of the printed circuit board;

a cable connected to a rear edge region of the printed circuit board and including a plurality of coaxial core wires, an inner insulator, a metallic braiding layer and an outer insulator sequentially arranged with one another outwardly; and each of the coaxial core wires including a center conductor, an insulating layer and another braiding layer sequentially arranged with one another outwardly in coaxial manner, all said coaxial core wires having an amount of fourteen and being arranged in two rows along a transverse direction wherein each row is equipped with seven coaxial core wires thereof, and including two differential pairs of high-speed signal lines at one end and another two differential pairs of high-speed signal lines at the other end with six coaxial core wires therebetween in the transverse direction; wherein said six coaxial core wires include a pair of low speed signal lines for transmitting USB 2.0 signals, a pair of spare signal lines, a detection signal line and a power supply line.

17. The cable connector assembly as claimed in claim 16, further including a pair of power lines enclosed within said inner insulator and commonly located by one side of said coaxial core wires in said transverse direction and respectively aligned with the corresponding rows in said transverse direction.

18. The cable connector assembly as claimed in claim 17, further including a metallic shielding case enclosing a rear portion of the mating member, the printed circuit board and a front portion of the cable, wherein a front end region of the braiding layer is folded backward to be pressed and electrically connected to the shielding case.

19. The cable connector assembly as claimed in claim 18, further including an insulative outer case which is preformed and attached unto to cover the shielding case.

20. The cable connector assembly as claimed in claim 19, further including a metallic foil sandwiched between the shielding case and the folded front end region of the braiding layer wherein said folded front end region of the braiding layer is initially retained by the metallic foil before the shielding case is assembled thereto.

* * * * *